United States Patent [19]

Kandel

[11] 4,261,760

[45] Apr. 14, 1981

[54] METHOD FOR ORIENTING PILE FIBERS OF A WET ELONGATED WEB

[75] Inventor: Thomas G. Kandel, Hartsdale, N.Y.

[73] Assignee: Ikon Technology Corp., Pompano Beach, Fla.

[21] Appl. No.: 17,814

[22] Filed: Mar. 5, 1979

Related U.S. Application Data

[62] Division of Ser. No. 625,049, Oct. 23, 1975, abandoned.

[51] Int. Cl.[3] ..... B08B 5/04

[52] U.S. Cl. ..... 134/15; 15/306 A; 15/420; 134/21

[58] Field of Search ..... 15/306 A, 415 R, 420; 134/15, 21; 162/279

[56] References Cited

U.S. PATENT DOCUMENTS

| | | | |
|---|---|---|---|
| 1,404,889 | 1/1922 | Owen | 15/420 |
| 1,586,358 | 5/1926 | Eurich | 162/279 |
| 2,905,241 | 9/1959 | Smith | 162/279 |
| 3,550,183 | 12/1970 | Wolf | 15/420 X |

FOREIGN PATENT DOCUMENTS

| | | | |
|---|---|---|---|
| 128421 | 7/1948 | Australia | 15/420 |

*Primary Examiner*—Marc L. Caroff
*Attorney, Agent, or Firm*—Howard C. Miskin

[57] ABSTRACT

Liquid is removed from a pile face of an elongated web and the pile is simultaneously oriented so that its lateral edges are folded inwardly and the remainder of the pile is rendered flat and unidirectional by advancing the web over a suction head having a suction port which extends transversely at least across the full width of the advancing web; the suction head also having passageways at transversely opposite ends of the suction port communicating with the exterior of the suction head.

3 Claims, 2 Drawing Figures

METHOD FOR ORIENTING PILE FIBERS OF A WET ELONGATED WEB

The present application is a divisional application of U.S. patent application Ser. No. 625,049 filed Oct. 23, 1975. now abandoned.

BACKGROUND OF THE INVENTION (1) Field of the Invention

This invention relates to a nap-folding fixture head used in association with a suction force for removing excess liquid material from a wet pile substrate strip and, at the same time, orienting the pile in a desired manner.

(2) Description of the Prior Art

Vacuum cleaners and vacuum heads for vacuuming dust and dirt from floors, carpets, walls, etc., are, of course, well known. This invention, while employing a vacuum force in association therewith, is adapted so that a wet pile strip will be subjected to a suction force in order to orient the pile fibers while at the same time removing excess liquid therefrom.

SUMMARY OF THE INVENTION

It is therefore among one of the principal objectives of this invention to provide a novel nap-folding fixture head which will have the combined action of removing excess liquid from a wet pile strip and simultaneously orienting the pile fibers.

In accord with the present invention there has now been provided a combination nap-folding fixture head used in association with a suction force for removing excess liquid material from a pile substrate strip treated with the same and simultaneously orienting the pile so that its lateral edges are folded inwardly and the remainder of the pile is rendered flat and unidirectional which comprises a generally elliptical annular body having a modified flat upper face portion, the annular body being joined to a tubular portion in air-flowing relation, the tubular portion being in turn connected to a source of vacuum. The invention device is used in helping to accomplish the objectives in my copending applications filed concurrently herewith, entitled "PROCESS FOR TREATING PILE MATERIALS MADE INTO ELECTROPHOTOGRAPHIC TONER REMOVAL BRUSHES" and "ELECTROPHOTOGRAPHIC TONER REMOVAL BRUSH AND METHOD OF MAKING SAME."

BRIEF DESCRIPTION OF THE DRAWINGS

The invention will be hereinafter more fully described with reference to the accompanying drawing in which.

DESCRIPTION OF THE PREFERRED EMBODIMENTS

Figure 1:
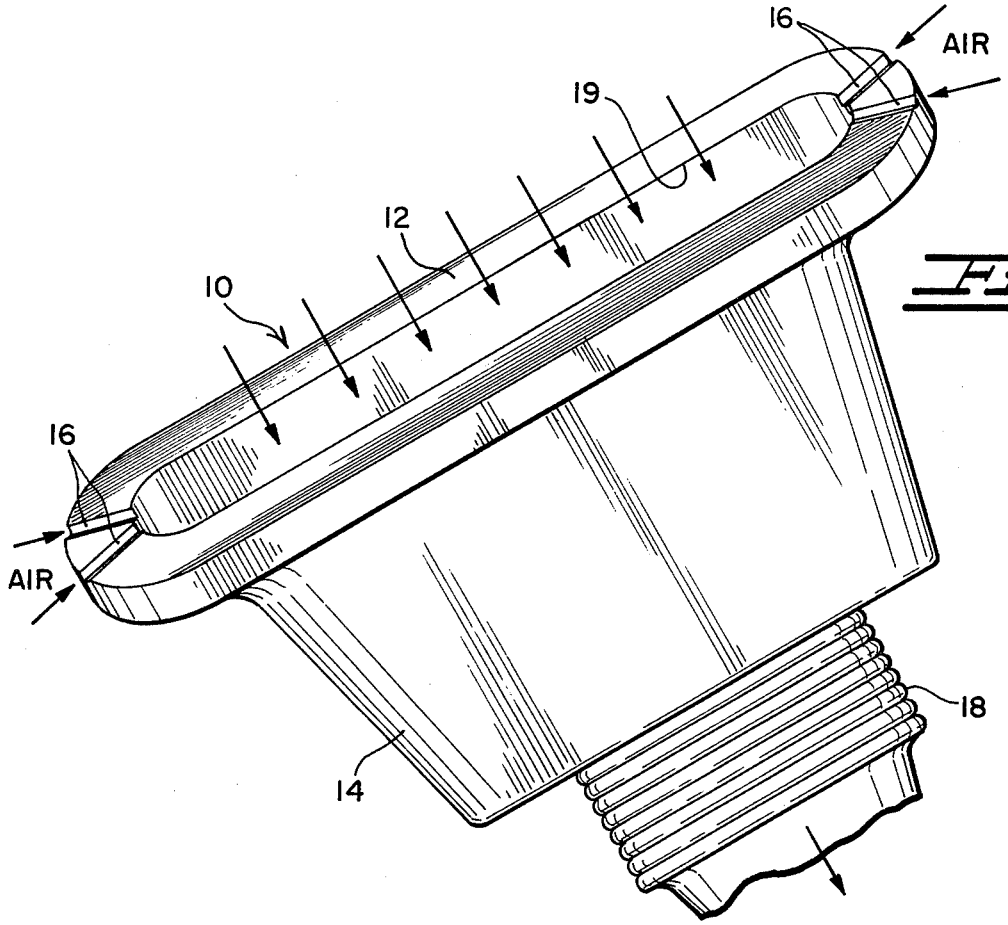
FIG. 1 is a view in perspective showing the invention device in association with a conventional vacuum device partially shown by its vacuum hose.

Referring now to the figures of the drawing there is illustrated therein the pile nap-folding fixture head 10 of the invention hereinafter referred to as "fixture head." The fixture head further comprises a generally elliptical annular body 11 having a flat upper face portion 12. Said annular body is joined to a tapered tubular portion 14 in air-flowing relation therewith, said tapered tubular portion being in turn connected to a conventional suction force (not shown) via a vacuum hose 18 only partially shown. The opposing longitudinal ends of the flat face 12 of the annular body 11 are modified by having cut therein V-shaped channel 16. A pair of these channels is provided at either end and these are diagonally inwardly directed into the fixture head opening 19. The purpose of these channels is for externally directed air ingress as will be more fully understood by the description hereinbelow. The fixture head may be made of hard plastic or a light metal, this is not critical.

Figure 2:
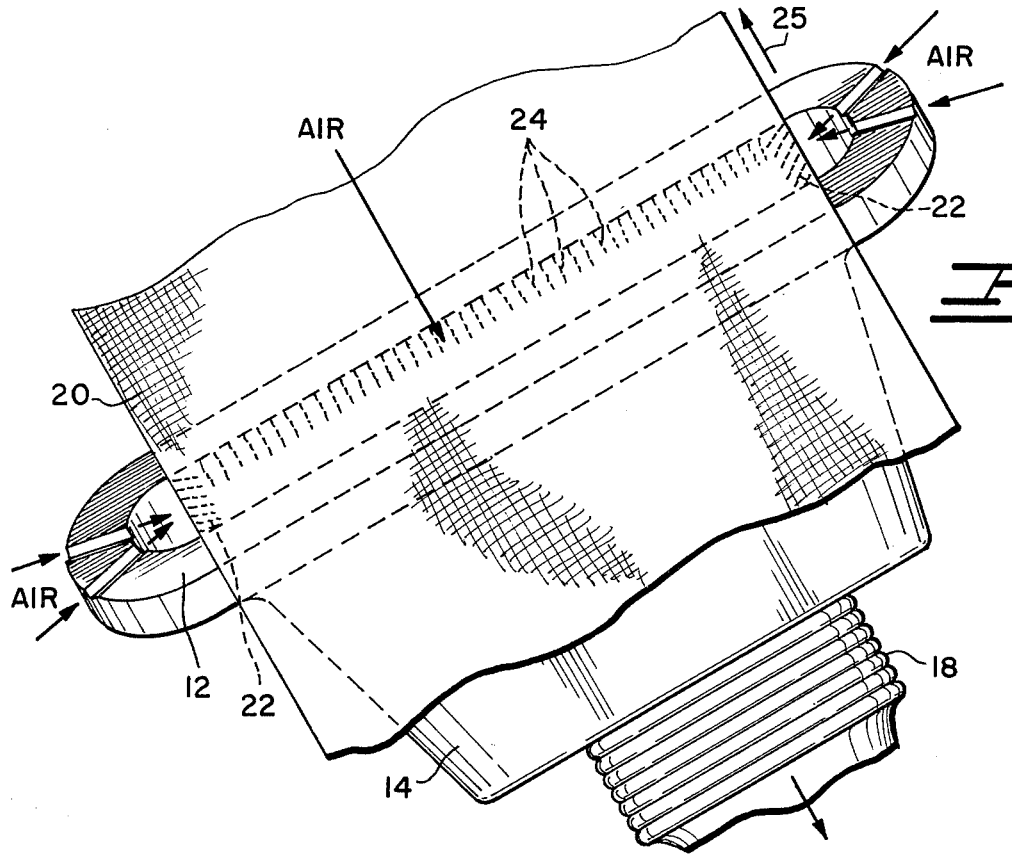
FIG. 2 is a similar view in perspective of the invention device, except that a pile strip is shown in flat face-to-face relation with the fixture head of the invention with the strip shown partially cut away.

Describing now the operation of the invention device, there is shown in FIG. 2 a portion of an elongated pile strip 20 overlain over the flat face portion 12 of the fixture head. The pile fibers are in turn overlain over the opening 19. The pile strip has been previously wetted in the manner according to my aforesaid copending applications, mentioned hereinabove, and with the suction force actuated in the direction of the arrow in vacuum hose 18. The wet strip 20 is passed over the flat face 12 in smooth abutting relation therewith in the direction of the arrow 25. In other words, the pile material is passed over the suction force exerted through the fixture opening 19. By the actuation of the aforementioned suction force, it can be clearly seen that air will be additionally drawn into the opening 19 via channels 16. This incoming rush of air forceably blows the lateral edges 22 of the pile material inwardly and at the same time the suction force is pulling down on the strands 24 of pile material straightening them and withdrawing excess solution at the same time. When the pile strands are pulled over the face portion 12 they are in turn flattened out against the strip. Thus, the simultaneous edge-folding and flat pile nap-folding is accomplished along with withdrawal of excess solution in the strip for the critical reasons described in my above mentioned copending patent applications.

What is claimed is:

1. The method of treating a longitudinally elongated web having longitudinally extending side edges and a liquid carrying pile face with transversely opposite longitudinal outer side borders comprising longitudinally advancing said web along the length thereof over a suction head connected to a suction source and having an outer exterior and a suction port which is transversely elongated relative to said advancing web and extends at least across the full width of said advancing web, said head being provided with passageways at transversely opposite ends of said port to provide communication between said exterior of said suction head and said transversely opposite ends of said port for establishing transversely directed jets of air to urge said pile along each of said side borders of said pile face transversely inwardly toward the respective other side border of said pile face to a predetermined orientation and simultaneously draw liquid from said pile face.

2. The method of claim 1 wherein said passageways are defined by a pair of channels formed at each of said transversely opposite ends of said suction port and converging inwardly from said suction head exterior toward the long medial axis of said port.

3. The method of claim 1 wherein said suction port extends transversely beyond said side edges of said advancing web.

* * * * *

UNITED STATES PATENT OFFICE
CERTIFICATE OF CORRECTION

PATENT NO. : 4,261,760
DATED : April 14, 1981
INVENTOR(S) : Thomas G. Kandel

It is certified that error appears in the above-identified patent and that said Letters Patent are hereby corrected as shown below:

On the title page

RELATED U.S. APPLICATION DATA

[62] "Division of" to --Continuation of--

Signed and Sealed this

*Fourth* Day of *August 1981*

[SEAL]

*Attest:*

GERALD J. MOSSINGHOFF

*Attesting Officer* *Commissioner of Patents and Trademarks*